US006606999B2

(12) United States Patent
Crooks et al.

(10) Patent No.: US 6,606,999 B2
(45) Date of Patent: Aug. 19, 2003

(54) REDUCED IGNITION PROPENSITY SMOKING ARTICLE

(75) Inventors: Evon Llewellyn Crooks, Winston-Salem, NC (US); Joanne Naomi Taylor, Germanton, NC (US)

(73) Assignee: R. J. Reynolds Tobacco Company, Winston-Salem, NC (US)

( * ) Notice: Subject to any disclaimer, the term of this patent is extended or adjusted under 35 U.S.C. 154(b) by 0 days.

(21) Appl. No.: 09/740,321

(22) Filed: Mar. 27, 2001

(65) Prior Publication Data

US 2002/0185143 A1 Dec. 12, 2002

(51) Int. Cl.[7] ..... A24D 1/00; A24D 1/02

(52) U.S. Cl. ..... 131/365; 131/360

(58) Field of Search ..... 131/374, 365, 131/370, 372, 194, 360, 361, 364; 162/139; 428/77, 535

(56) References Cited

U.S. PATENT DOCUMENTS

| | | | | | |
|---|---|---|---|---|---|
| 680,003 | A | * | 8/1901 | Simering | |
| 2,192,569 | A | * | 3/1940 | Williams | 131/349 |
| 2,666,437 | A | | 1/1954 | Lattof | |
| 3,165,105 | A | * | 1/1965 | Campbell | 131/349 |
| 3,370,593 | A | * | 2/1968 | Owaki | |
| 4,077,414 | A | | 3/1978 | Baker et al. | |
| 4,239,591 | A | | 12/1980 | Blake | |
| 4,243,053 | A | * | 1/1981 | Cartwright et al. | 131/4 |
| 4,452,259 | A | | 6/1984 | Norman et al. | |
| 4,453,553 | A | | 6/1984 | Cohn | |
| 4,480,650 | A | | 11/1984 | Weinert | |
| 4,489,738 | A | | 12/1984 | Simon | |
| 4,615,345 | A | | 10/1986 | Durocher | |
| 4,622,983 | A | | 11/1986 | Mathews et al. | |
| 4,637,410 | A | * | 1/1987 | Luke | 131/361 |
| 4,739,775 | A | | 4/1988 | Hampl, Jr. | |
| 4,889,145 | A | | 12/1989 | Adams et al. | |
| 4,945,932 | A | | 8/1990 | Mentzel et al. | |
| 5,060,675 | A | | 10/1991 | Milford et al. | |
| 5,191,906 | A | | 3/1993 | Myracle, Jr. | |
| 5,244,530 | A | * | 9/1993 | Collins et al. | 156/519 |
| 5,263,500 | A | | 11/1993 | Baldwin et al. | |
| 5,263,999 | A | | 11/1993 | Baldwin et al. | |
| 5,271,419 | A | * | 12/1993 | Arzonico et al. | 131/365 |
| 5,322,076 | A | * | 6/1994 | Brinkley et al. | 131/174 |
| 5,417,228 | A | | 5/1995 | Baldwin et al. | |
| 5,450,863 | A | | 9/1995 | Collins et al. | |
| 5,474,095 | A | | 12/1995 | Allen et al. | |
| 5,598,868 | A | * | 2/1997 | Jakob et al. | 131/359 |
| 5,645,089 | A | * | 7/1997 | Burger et al. | 131/365 |
| 5,709,228 | A | * | 1/1998 | Cohen et al. | 131/365 |
| 5,878,753 | A | | 3/1999 | Peterson et al. | |
| 5,878,754 | A | | 3/1999 | Peterson et al. | |
| 6,095,152 | A | * | 8/2000 | Beven et al. | 131/194 |
| 6,129,087 | A | | 10/2000 | Wallace et al. | |
| 6,286,516 | B1 | * | 9/2001 | Bowen et al. | 131/365 |
| 6,289,898 | B1 | * | 9/2001 | Fournier et al. | 13/365 |

* cited by examiner

*Primary Examiner*—Steven P. Griffin
*Assistant Examiner*—Carlos Lopez
(74) *Attorney, Agent, or Firm*—Brinks Hofer Gilson & Lione

(57) ABSTRACT

The invention provides an easy to manufacture smoking article having a reduced ignition propensity and an increased puff count. The smoking article of the invention comprises a rod of smokable material disposed within a wrapper having a strip of paper material forming a region having at least two paper layers aligned substantially parallel to the longitudinal axis of the smoking article. One of the paper layers of the region may be tobacco paper, and preferably has a porosity between 0 and 20 Coresta units.

20 Claims, 1 Drawing Sheet

FIG. 1
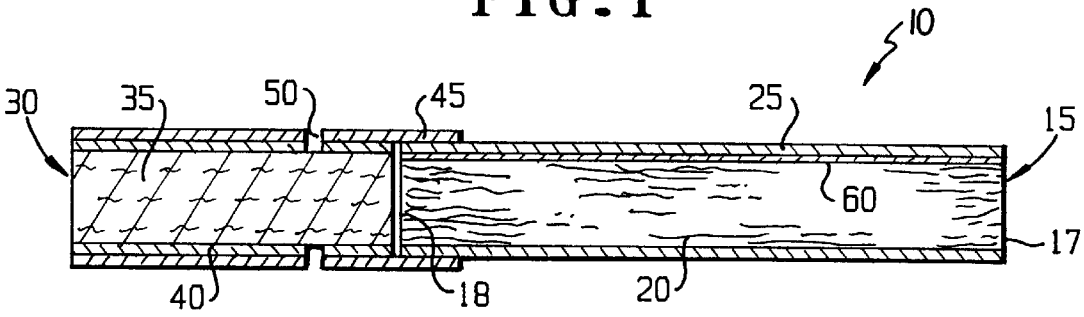
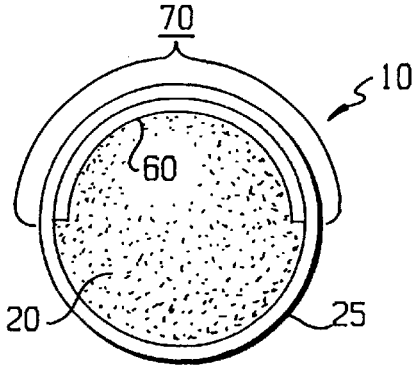
FIG. 2
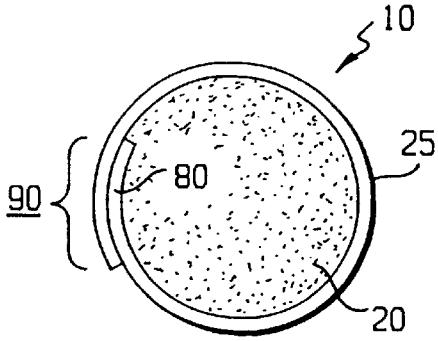
FIG. 3

REDUCED IGNITION PROPENSITY SMOKING ARTICLE

BACKGROUND OF THE INVENTION

1. Field of the Invention

The present invention relates to a smoking article and a wrapper for a smoking article that provide substantially reduced ignition propensity in the smoking article, particularly in the case of a cigarette. When a smoking article, such as a cigarette, employing the wrapper of the invention is dropped or left on a flammable substrate, the cigarette tends to self-extinguish before igniting the flammable substrate.

2. Description of the Prior Art

There is a recognition in the industry that the smoking article wrapper has a significant influence on the reduction of ignition propensity. Several solutions have been proposed to solve the problem of providing a low ignition propensity cigarette involving modification of the porosity of the smoking article wrapper.

For example, it is known that the burn characteristics of a wrapper can be modified by adding fillers, coatings or additives to the wrapper. U.S. Pat. No. 4,480,650 to Weinert discloses a self-extinguishing cigarette in which the interior surface of the wrapper is coated with clay. U.S. Pat. No. 4,889,145 to Adams et al. discloses a cigarette wrapper having an area containing a discontinuous coating of porosity reducing composition. U.S. Pat. No. 4,615,345 to Durocher discloses a cigarette having cross-directional or circumferential bands treated with burn promoter wherein the untreated paper does not support combustion and the cigarette self-extinguishes when the cigarette burns into the untreated area of the wrapper. U.S. Pat. No. 4,453,553 to Cohn attempts to improve upon both sidestream smoke characteristics and fire resistance by the use of longitudinal stripes of burn rate reducing substances and optionally an additional layer of cigarette wrapper paper.

Modification of the smoking article wrapper by the modifying the base paper properties in certain regions or applying to the base paper a cross directional ring or piece of paper having different properties than the base paper have been proposed. U.S. Pat. No. 4,945,932 to Mentzel et al. discloses a cigarette wrapper paper having annular zones of low permeability formed by a batonneing process. U.S. Pat. No. 4,739,775 to Hampl, Jr. discloses the application of circumferential bands of paper having reduced filler content onto the inside of the base paper to form smoking articles that are self-extinguishing in the two layer circumferentially banded zones. U.S. Pat. No. 5,474,095 to Allen et al discloses a wrapper paper having cross-directional or circumferential regions with increased basis weight that is produced in the papermaking process by depositing additional material onto the base web in the papermaking machine using a drum containing a plurality of slits.

The use of chemical additives described above to form longitudinal strips is undesirable as to the potential effects of the chemicals, as is the cost and effort involved in use of complex papermaking equipment to influence the physical properties of the paper by decreasing permeability in longitudinal strips along the paper.

It would be desirable to provide a simple, easy to manufacture smoking article having a reduced ignition propensity which does not require the use of extensive process modifications and/or additional processing equipment, chemical additives or the like in its manufacture. It would also be desirable to provide a smoking article having a reduced ignition propensity that could be made with the use of readily available, conventional materials and with existing process equipment, without sacrificing the look, feel, taste and burn of a conventional cigarette.

It would also be desirable to provide a smoking article with a reduced ignition propensity as well as an increased puff count over a conventional smoking article with the same tobacco rod content and physical characteristics.

SUMMARY OF THE INVENTION

The invention provides smoking article having a reduced ignition propensity which is also easy to manufacture. The smoking article of the invention does not require the use of extensive process modifications and/or additional processing equipment, or a requirement for chemical additives or the like in its manufacture. The invention also provides a reduced ignition propensity smoking article having an increased puff count for a given tobacco rod.

The smoking article and the smoking article wrapper of the invention provide smoking articles having reduced ignition propensity. The smoking article of the invention comprises a rod of smokable material, such as tobacco, disposed in a wrapper and having a first end, a second end opposed to the first end and a longitudinal axis extending from the first end to the second end. The wrapper comprises a strip of paper material forming a region having at least two paper layers aligned substantially parallel to the longitudinal axis. The paper material for one of the layers may be tobacco paper.

BRIEF DESCRIPTION OF THE DRAWINGS

FIG. 1 shows a smoking article of the invention in cross section along the longitudinal axis;

FIG. 2 shows an embodiment of the smoking article of the invention in cross section; and FIG. 3 shows an embodiment of the smoking article of the invention in cross section.

DETAILED DESCRIPTION OF THE INVENTION

One embodiment of a reduced ignition propensity smoking article of the present invention is shown in FIG. 1. A smoking article, shown in FIG. 1 as cigarette 10, includes a generally cylindrical rod 15 of a charge or roll of smokable material 20 contained in a circumscribing wrapping material 25. The rod 15 is conveniently referred to as a "smokable rod" or a "tobacco rod." The cylindrical rod 15 has a first free end 17, a second end 18 opposed to the first end 17 and a longitudinal axis extending between the ends. The ends 17, 18 of the tobacco rod are open, i.e., are not covered by the wrapping material 25, to expose the smokable filler material.

The cigarette 10 typically includes a filter element 30 or other suitable mouthpiece positioned adjacent the end 18 of the tobacco rod 15 such that the filter element and tobacco rod are axially aligned in an end-to-end relationship, preferably abutting one another. Filter element 30 also has a generally cylindrical shape, and the diameter thereof is essentially equal to the diameter of the overwrapped tobacco rod. The ends of the filter element are open to permit the passage of air and smoke therethrough. The filter element 30 includes a filter material 35 which is overwrapped along the longitudinally extending outer surfaces thereof with a circumscribing plug wrap material 40. The filter element may have two or more filter segments, and/or flavor additives incorporated therein.

The filter element 30 is attached to the tobacco rod 15 by tipping material 45, such as a paper material, which may, as shown in FIG. 1, circumscribe both the entire length of the filter element and an adjacent region or length of the overwrapped tobacco rod. The inner surface of the tipping material 45 is fixedly secured to the outer surface of the plug wrap 40 and the outer surface of the wrapping material 25 of the tobacco rod, using a suitable adhesive. A ventilated or air diluted smoking article may be provided with an air dilution means, such as a series of perforations 50, each of which extend through the tipping material and plug wrap.

In embodiments of the invention shown in cross-section in FIG. 2, the wrapping material 25 has a width which is equal to the circumference of the cigarette plus the lap zone of the glue line (not shown) which ultimately results during cigarette manufacture. The width of the lap zone of the glue line is approximately 1 to 2 mm. In this embodiment, the wrapping material 25 also comprises a strip of paper material 60 forming a region having at least two paper layers 70 that is aligned substantially parallel to the longitudinal axis of the smoking article. The strip 60 may be attached to the wrapping material 25 with a suitable adhesive or it may be simply be laid onto the wrapping material before the smoking material is placed on the wrapping material. The strip 60 may also be present either on the inside of wrapping material 25 as shown in FIG. 2, or it may be attached to the outside of the wrapping material 25, for example, with an adhesive. In embodiments of the invention, a plurality of longitudinal strips 60 may be used and placed on the inside, outside or on both sides of wrapping material 25.

Generally, according to the invention, paper strip material 60 is made from paper and does not contain any substantial amounts of metal or other heat conductive materials. Paper strip material 60 may be a paper similar or identical to that used as wrapping material 25, the details of which are described below, or it may be tobacco paper with similar characteristics. The width of paper strip 60 is greater than about 2 mm and may be from about 5 mm to about 20 mm, preferably from about 10 mm to about 15 mm. In embodiments of the invention having a plurality of longitudinal paper strips 60, the width of all paper strips 60 combined is greater than about 2 mm and may be from about 5 mm to about 20 mm, preferably from about 10 mm to about 15 mm. The basis weight of the paper used to form paper strip 60 may be from about 20 grams/$m^2$ (gsm) to about 250 gsm, preferably from about 100 gsm to about 150 gsm. The porosity of the paper used to form paper strip 60 may be from about 0 Coresta units to about 20 Coresta units, and preferably from about 0 Coresta units to about 10 Coresta units, and most preferably from about 4–6 Coresta units. The thickness of the paper used to form paper strip 60 may be from about 0.050 mm to about 0.100 mm, and preferably from about 0.065 mm to about 0.085 mm. Paper strip 60 may extend the entire length of tobacco rod 15, as shown in FIG. 1, or it may be shorter in length, for example, 50% or more of the length of tobacco rod 15. Such partial longitudinal paper strips may extend from end 17 toward the middle of the tobacco rod 15, or alternately may extend from end 18 toward the middle of the tobacco rod 15. Typically, the tobacco rod 15 has a length ranging from about 50 mm to about 85 mm, and a circumference of about 16 mm to about 28 mm.

In the embodiments of the invention wherein an additional strip of paper material 60 is added to the wrapping material 25, the smoking articles of the invention may be manufactured by placing (or adhering with a suitable adhesive) a longitudinal strip (or strips) of paper material 60 on a running web of wrapping material 25 at the appropriate spacing and location according to the desired number of strips 60 for a smoking article. The web of material comprising wrapper 25 and strip 60 can then be fed to a conventional cigarette making machine for producing a smoking article according to the invention. Alternately, conventional double wrap technology, such as that disclosed in U.S. Pat. No. 4,561,454, for example, can be used by feeding paper strip 60 and cigarette paper 25 simultaneously into a cigarette making machine to manufacture smoking articles in accordance with the invention.

In other embodiments of the invention shown in cross section in FIG. 3, the wrapping material 25 has a width which is substantially wider that the circumference of the cigarette plus the lap zone of the glue line which ultimately results during cigarette manufacture. In this embodiment, the additional width of wrapping material, i.e., that integral section of wrapping material that is wider than the circumference of the cigarette plus the lap zone of the glue line, is designated as strip of paper material 80. This strip 80 may have identical properties to the wrapping material 25 although the properties of that section of the wrapper which is paper strip 80 may be varied from the properties of the base paper of wrapping material 25. Thus, the outer layer of wrapping material 25 together with the integral inner layer of overlapping additional width of wrapping material 80, form a region having at least two paper layers 90 that is aligned substantially parallel to the longitudinal axis of the smoking article.

Combinations of the embodiments shown in FIG. 2 and FIG. 3 are also within the scope of the invention, i.e., an overlap paper strip 80 in combination with an adhered paper strip 60 forming one or more regions 70, 90 having two or more paper layers.

Although the basis weights of the wrapping material 25 for the tobacco rod can vary, preferred wrapping materials often have relatively low basis weights. Typical basis weights for such wrapping materials can be as low as about 20 gsm, generally are about 25 gsm or more, and sometimes are about 35 gsm or more. Typical basis weights of the wrapping material 25 do not exceed about 80 gsm.

Wrapping materials 25 for the tobacco rod can have a wide range of permeabilities or porosities. Typical wrapping materials have inherent permeabilities, which range from about 5 Coresta units to about 75 Coresta units, and preferably average about 30 Coresta units. Although not preferred, wrapping materials can be electrostatically perforated.

Typical wrapping materials 25 are paper wrapping materials which contain about 55 to about 95 weight percent, preferably about 65 to about 90 weight percent cellulosic material; and about 5 to about 45 weight percent, preferably about 10 to about 35 weight percent inorganic filler. The preferred inorganic filler is calcium carbonate, although other fillers and combinations of other fillers with calcium carbonate can be employed. Preferred paper wrapping materials contain up to about 45 percent, more preferably up to about 35 percent, and most preferably about 25 to about 35 percent, by weight of calcium carbonate. The inorganic filler provides a desired opacity to the paper. The preferred papers also contain flax fibers, wood pulp, esparto fiber, sisal fibers, or other cellulosic material to provide a cellulosic base web. Mixtures of two or more types of cellulosic materials can be employed. The selection of inorganic fillers and cellulosic materials for the manufacture of smokable rod wrapping materials will be apparent to the skilled artisan.

Typically, the filter element has a length that ranges from about 20 mm to about 35 mm and a circumference of about 16 mm to about 28 mm. The filter material can be any suitable material such as cellulose acetate, polypropylene, tobacco material, or the like. The smokable filler material employed in the manufacture of the smokable rod can vary as is known in the art and may be preferably an "American blend" of tobacco materials. As used herein, "packing density" means the weight of the filler material that occupies a unit volume within the smokable rod. For smoking articles according to this invention, the packing density generally ranges from about 100 mg/cm$^3$ to about 300 mg/cm$^3$.

Flavorants can be incorporated into the cigarettes. For example, the filler materials can be employed with casing or top dressing additives. Flavorants such as menthol can be incorporated into the cigarette using techniques familiar to the skilled artisan.

In embodiments of the invention, the puff count of the smoking article of the invention is increased, relative to an identical smoking article not having the additional strip of paper material 60 or overlapped material 80 forming a region 70 or 90 having at least two layers of paper material.

The following examples illustrate the invention:

EXAMPLE 1

Eight Camel Light® 85 cigarettes ("the control cigarettes") manufactured on conventional cigarette making machinery were tested for ignition propensity together with eight cigarettes made according to the invention ("the invention cigarettes"). The eight invention cigarettes were made on a Ryo Filtermatic cigarette maker manufactured by the Sutliff Tobacco Company of Richmond, Va. The tobacco for making the invention cigarettes on the Ryo maker was taken from conventionally manufactured Camel cigarettes. Regular Camel cigarette paper was used to make the invention cigarettes. A 13 mm wide strip of tobacco paper was laid longitudinally on the Camel cigarette paper and the tobacco from the Camel cigarettes was laid on top of the strip. The cigarettes were rolled on the Ryo maker and a filter was added to each of the invention cigarettes with tipping paper in a conventional manner. The invention cigarettes had substantially the same weight and the same tobacco blend as the Camel Light 85 control cigarettes. All of the cigarettes were tested on 10 layers of Whatman #2 filter paper in accordance with the Cigarette Extinction Test Method of the National Institute of Standards and Technology (NIST). The results of this test are shown below in Table I.

The cigarettes made in accordance with the invention did not self-extinguish in the holder. As shown in Table I, 88% of the invention cigarettes (7 of 8) self-extinguished on the paper substrate. This was accomplished with approximately 35 mm of the tobacco rod of the invention cigarettes remaining. In contrast, at least 88% of the control cigarettes (7 of 8) burned completely through one layer of the Whatman #2 filter paper substrate and none self-extinguished. Each of the eight control cigarettes affected every layer of the 10 layer substrate since the total number of layers affected for all eight control cigarettes was 80, i.e., 7 layers were "burnt completely through," 14 layers were "burnt but not completely through," 24 layers were "heavily scorched," 24 layers were "scorched," and 11 layers were "lightly scorched." In contrast, the eight invention cigarettes affected only 51 layers of the total 80 layers of substrate, i.e., 2 layers were "burnt but not completely through," 3 layers were "heavily scorched," 17 layers were "scorched," 16 layers were "lightly scorched," and 13 layers were "barely scorched," leaving 29 layers not affected.

EXAMPLE 2

In a second test designated FL1825 IP, eight Camel Light® 85 cigarettes ("the control cigarettes") manufactured on conventional cigarette making machinery were tested for ignition propensity together with eight cigarettes made according to the invention ("the invention cigarettes"). The eight invention cigarettes for this example were made on a laboratory scale Hauni Protos cigarette maker manufactured by Körber of Germany, modified in accordance with the apparatus for double wrapping cigarettes described in U.S. Pat. No. 5,156,169. The tobacco for making the invention cigarettes on the Hauni Protos maker was taken from conventionally manufactured Camel cigarettes. Regular Camel cigarette paper was used to make the invention cigarettes. A 13 mm wide strip of tobacco paper was used as the second sheet for the double wrap apparatus. The cigarettes were made on the Hauni Protos maker and filters were added to each of the invention cigarettes by the Hauni Protos maker. The invention cigarettes had substantially the same weight and the same tobacco blend as the Camel Light 85 control cigarettes. All of the cigarettes were tested on 10 layers of Whatman #2 filter paper in accordance with the Cigarette Extinction Test Method of the National Institute of Standards and Technology (NIST). The results of the FL1825 IP test are shown below in Table II.

TABLE I

| | | | Number of Cigarettes Which | | | | | | | | | | | | | | |
|---|---|---|---|---|---|---|---|---|---|---|---|---|---|---|---|---|---|
| | SE* in | SE* on | Burnt Completely Through Number of Affected Layers | | Burnt but Not Completely through Number of Affected Layers | | Heavily Scorched Number of Affected Layers | | | Scorched Number of Affected Layers | | | Lightly Scorched Number of Affected Layers | | Barely Scorched Number of Affected Layers | | |
| | holder | Substrate | 2 | 1 | 2 | 1 | 3 | 2 | 1 | 3 | 2 | 1 | 2 | 1 | 3 | 2 | 1 |
| Invention Cigarettes | 0 | 7 | — | — | 1 | — | 1 | — | — | 2 | 5 | 1 | 8 | — | — | 6 | 1 |
| Control Cigarettes | 0 | 0 | | 7 | 6 | 2 | 8 | — | — | 8 | — | — | 3 | 5 | — | — | — |

*SE = self-extinguished

TABLE II

| | SE* in holder | SE* on Substrate | Number of Cigarettes Which: Burnt Completely Through Number of Affected Layers | | Burnt but Not Completely through Number of Affected Layers | | Heavily Scorched Number of Affected Layers | | | Scorched Number of Affected Layers | | | Lightly Scorched Number of Affected Layers | | Barely Scorched Number of Affected Layers | | |
|---|---|---|---|---|---|---|---|---|---|---|---|---|---|---|---|---|---|
| | | | 2 | 1 | 2 | 1 | 3 | 2 | 1 | 3 | 2 | 1 | 2 | 1 | 3 | 2 | 1 |
| Invention Cigarettes | 0 | 6 | — | — | 2 | 1 | 3 | — | — | 2 | 5 | 1 | 6 | 2 | — | 3 | 5 |
| Control Cigarettes | 0 | 0 | | 1 | 6 | 2 | 8 | — | — | 8 | — | — | 7 | 1 | — | — | 2 |

*SE = self-extinguished

The cigarettes made in accordance with the invention did not self-extinguish in the holder. As shown in Table II, 75% of the invention cigarettes (6 of 8) self-extinguished on the paper substrate. Five of the extinguishments had an average of 35 mm of the tobacco rod remaining, one extinguishment had 5 mm of the tobacco rod remaining, and two of the invention cigarettes had full-length burns. In contrast, none of the control cigarettes self-extinguished and one burned completely through one layer of the Whatman #2 filter paper substrate. Each of the eight control cigarettes affected every layer of the 10 layer substrate since the total number of layers affected for all eight control cigarettes was 80, i.e., 1 layer was "burnt completely through," 14 layers were "burnt but not completely through," 24 layers were "heavily scorched," 24 layers were "scorched," 15 layers were "lightly scorched," and 2 layers were "barely scorched." In contrast, the eight invention cigarettes affected only 56 layers of the total 80 layers of substrate, i.e., 5 layers were "burnt but not completely through," 9 layers were "heavily scorched," 17 layers were "scorched," 14 layers were "lightly scorched," and 11 layers were "barely scorched," leaving 24 layers not affected.

EXAMPLE 3

A 13 mm wide strip of tobacco paper was placed on the inside of the white cigarette wrapper paper of eight (8) Camel Light® 85 cigarettes ("the invention cigarettes") and an equal number of standard Camel Light® 85 cigarettes ("the control cigarettes") all 57 mm in length were used for controls. The tobacco paper strip had a thickness of 0.08 mm, a porosity of 6.0 Coresta units and a basis weight of 89 gsm. The cigarettes were tested for puff count under standard FTC conditions. The results are shown below in Table III. The puff count of the cigarettes in accordance with the invention was greater than the control by 14.6%.

TABLE III

| | Camel Lt. Control | Invention Cigarette |
|---|---|---|
| Air dilution % | 21 | 18.5 |
| Pressure Drop, mm of water | 118.7 | 108.6 |
| Number of Puffs | 8.2 | 9.4 |
| WTPM,* mg | 13.2 | 17.8 |
| Nicotine | .91 | 1.07 |
| Tar, mg | 10.8 | 14.3 |
| CO, mg | 11.0 | 17.8 |
| $CO_2$, mg | 37.2 | 46.8 |

*Wet Total Particulate Matter

Although certain presently preferred embodiments of the invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

What is claimed is:

1. A manufactured smoking article having reduced ignition propensity, said smoking article comprising a rod of smokable material disposed within a wrapper and having a first end, a second end opposed to said first end and a longitudinal axis extending from said first end to said second end, said rod having a given circumference, said wrapper comprising a strip of paper material forming a narrow region having at least two paper layers, said narrow, two paper layer region being arranged substantially parallel to said longitudinal axis and having a width in a circumferential direction greater than about 2 mm, but less than the given circumference of the rod, said strip of paper having a porosity from about 0 Coresta units to about 20 Coresta units, whereby the ignition propensity of the smoking article is reduced.

2. The smoking article of claim 1, wherein said region has a width of from about 5 mm to about 20 mm.

3. The smoking article of claim 2, wherein said region has a width of from about 10 mm to about 15 mm.

4. The smoking article of claim 2, wherein said region is formed by an overlap of the wrapper.

5. The smoking article of claim 1, wherein said region includes a strip of tobacco paper.

6. The smoking article of claim 1, wherein said paper strip is disposed between the wrapper and the rod of smokable material.

7. The smoking article of claim 1, wherein said paper strip has a basis weight from about 20 gsm to about 250 gsm.

8. The smoking article of claim 1, wherein said paper strip has a porosity from about 0 Coresta units to about 10 Coresta units.

9. The smoking article of claim 1, wherein said paper strip has a thickness from about 0.050 mm to about 0.100 mm.

10. The smoking article of claim 1, having an increased puff count relative to an identical smoking article without said strip of paper material forming a region having at least two layers.

11. A smoking article wrapper for reducing ignition propensity of a manufactured smoking article comprising a rod of smokable material having a longitudinal axis and a circumference, said wrapper comprising an elongate first strip of paper material having a longitudinal axis and a given width, said wrapper being adapted to be wrapped about the circumference of the rod of smokable material of the manufactured smoking article with the longitudinal axes of the rod and wrapper substantially parallel, a narrow second strip of paper material disposed on said first strip of paper material and being aligned substantially parallel to the longitudinal axis of the first strip and having a width less than the given width so as to form a narrow, two paper layer region of said wrapper such that, when the wrapper is wrapped about the rod of smokable material, the circumferential extent of the narrow, two paper layer region is less than the circumference of the rod, the second strip having a porosity from about 0 Coresta units to about 20 Coresta units, whereby the ignition propensity of the smoking article manufactured with said wrapper is reduced.

12. The smoking article wrapper of claim 11, wherein said second strip has a width of from about 5 mm to about 20 mm.

13. The smoking article wrapper of claim 11, wherein said second strip has a width of from about 10 mm to about 15 mm.

14. The smoking article wrapper of claim 11, wherein one of said strips is a tobacco paper strip.

15. The smoking article wrapper of claim 11, wherein said second strip has a basis weight from about 20 gsm to about 250 gsm.

16. The smoking article wrapper of claim 11, wherein said second strip has a thickness from about 0.050 mm to about 0.100 mm.

17. A manufactured smoking article having reduced ignition propensity, said smoking article comprising a rod of smokable material disposed within a wrapper and having a first end, a second end opposed to said first end, a longitudinal axis extending from said first end to said second end and a circumference, said wrapper comprising a first strip of paper material wrapped about the circumference of the rod and having overlapping edges forming a glue lap zone, a second strip of paper disposed adjacent said first strip of paper and arranged substantially parallel to said longitudinal axis to form a narrow region of two layers of paper material, said second strip of paper having a circumferential width substantially less than the circumference of the rod, said second strip of paper having a porosity from about 0 Coresta units to about 20 Coresta units, whereby the ignition propensity of the smoking article is reduced.

18. The manufactured smoking article of claim 17, wherein said second strip of paper has a circumferential width of from about 5 mm to about 20 mm.

19. The manufactured smoking article of claim 17, wherein said second strip has a thickness of from about 0.050 mm to about 0.100 mm.

20. A manufactured smoking article having reduced ignition propensity, said smoking article comprising a rod of smokable material disposed within a wrapper and having a first end, a second end opposed to said first end, a longitudinal axis extending from said first end to said second end and a given circumference, said wrapper comprising a strip of paper material wrapped circumferentially about the rod and overlapping itself to form a narrow region of two layers of the paper material arranged substantially parallel to said longitudinal axis and having a width of at least about 5 mm, but less than the given circumference of the rod and a porosity of about 0 to about 10 Coresta units whereby the ignition propensity of the smoking article is reduced.

* * * * *